United States Patent [19]

Lemaignen

[11] Patent Number: 4,592,769

[45] Date of Patent: Jun. 3, 1986

[54] PROCESS AND APPARATUS FOR THE FORMATION OF FIBER FELTS

[75] Inventor: Henry Lemaignen, Chantilly, France

[73] Assignee: Isover Saint-Gobain, Courbevoie, France

[21] Appl. No.: 587,980

[22] Filed: Mar. 9, 1984

[30] Foreign Application Priority Data

Mar. 10, 1983 [FR] France ..... 83 03919

[51] Int. Cl.[4] ..... C03B 37/065

[52] U.S. Cl. ..... 65/4.4; 65/9; 65/29; 65/163; 156/62.4

[58] Field of Search ..... 65/4.4, 9, 29, 160, 65/163; 156/62.4

[56] References Cited

U.S. PATENT DOCUMENTS 3,539,316 11/1970 Trethewey ..... 65/29 X
4,046,538 9/1977 Thomas ..... 65/4.4
4,168,959 9/1979 Loeffler ..... 65/4.4 X
4,210,432 7/1980 Brelén et al. ..... 65/4.4
4,263,033 4/1981 Michalek ..... 65/29 X

FOREIGN PATENT DOCUMENTS 199745 7/1967 U.S.S.R. ..... 65/4.4

*Primary Examiner*—Robert Lindsay
*Attorney, Agent, or Firm*—Oblon, Fisher, Spivak, McClelland & Maier

[57] ABSTRACT

A process for the improvement in the distribution of fibers in a fiber felt formed by retention of fibers entrained in a gaseous current is disclosed, along with apparatus suitable for practicing that process. The gaseous current is caused to pass through an oscillating guide duct, the frequency, amplitude and median direction of the oscillation, or at least one of those aspects, may be automatically regulated and altered in response to sensed variations in the distribution of the fiber. The distribution variations are measured by determining relative absorption of radiation across different portions of the width of the felt in comparison with the mean value of that distribution.

10 Claims, 11 Drawing Figures

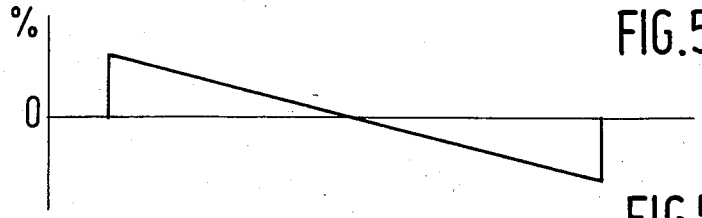
FIG.5a
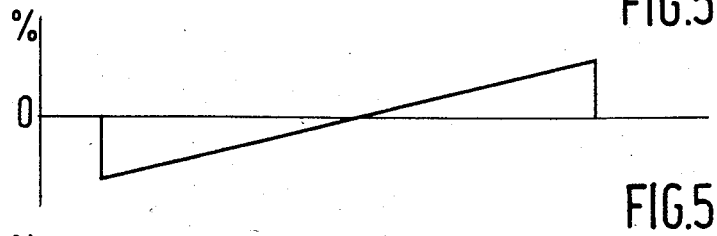
FIG.5b
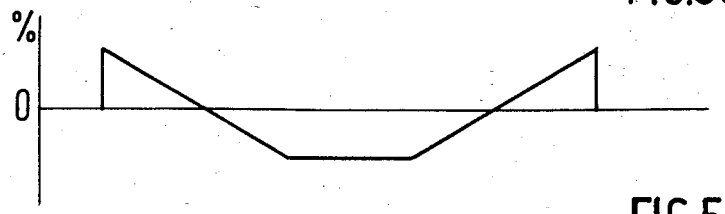
FIG.5c
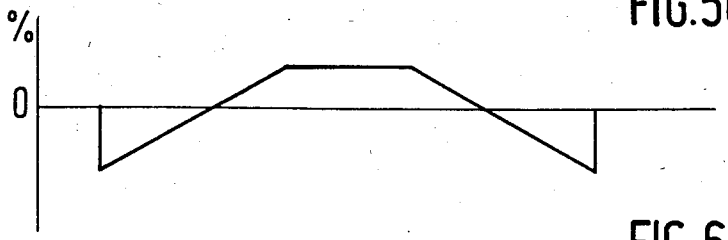
FIG.5d
FIG. 6
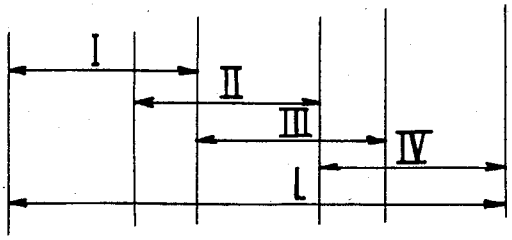

PROCESS AND APPARATUS FOR THE FORMATION OF FIBER FELTS

BACKGROUND OF THE INVENTION

1. Field of the Invention

This invention relates to improvements in techniques for the formation of felts, and in particular thick felts such as those used for heat and sound insulation.

2. Background of the Prior Art

The formation of felts from fibers carried by a gaseous current is traditionally carried out by passing this current through a perforated receiving conveyor which holds back the fibers. To bond the fibers to each other, a binder is sprayed over the fibers in the course of their path to the receiving conveyor. This binder is subsequently hardened, for example by a heat treatment.

This technique is employed in particular for the production of mineral fiber felts. Hereinafter the formation of felts from fibers of vitreous materials is exclusively referred to due to the importance of this type of production but the invention is nevertheless applicable to all processes of producing felts, whether from mineral or from organic fibers.

One of the difficulties encountered in the preparation of these felts is connected with the uniform distribution of the fibers within the felt. The gaseous current carrying the fibers normally has a cross section of limited width which is a function, in particular, of the apparatus used for the production of the fibers. Moreover, the gaseous current normally does not cover the whole width of the conveyor, and the fibers are not uniformly distributed.

Various means have been proposed for improving the distribution of the fibers on the conveyor. One of the most useful of these means is of the type described in U.S. Pat. No. 3,134,145. It consists of passing the gaseous flux carrying the fibers through a guide duct. This duct is movable and is subjected to an oscillating movement which alternately directs the gaseous flux from one edge to the other of the conveyor receiving the fibers.

If the operating conditions are suitably chosen, the fibers are deposited by these means over the whole width of the conveyor.

In practice, however, it has been found that a strictly uniform distribution is very difficult to obtain. Deviations of the mass of fibers per unit surface area of as much as 15% or more from the mean value are encountered in samples taken at different points over the width of the felt. It is therefore necessary to improve the practical execution of this technique of distribution in order to reduce as much as possible the variations found in the distribution of the fibers.

It is an object of this invention to provide an improved technique for the distribution of fibers in the formed felts.

The invention particularly has the object of providing a process whereby variations in distribution appearing in the course of operation can be corrected.

The invention also has the aim of enabling the correction in the variations of fiber distribution to be carried out automatically.

SUMMARY OF THE INVENTION

These objects are achieved by means of the invention, according to which the parameters determining the oscillating movement of the guide duct may be varied during the course of operation. Permanent measures for the distribution of the fibers within the form felt also enable the conditions for the best possible distribution to be re-established at each instant through feedback according to pre-established corrections as a function of the deviations detected in relation to the desired distribution.

By continuously measuring the density of fiber distribution in the felt being formed, distributional errors can be corrected during operation by altering the distribution mechanism, the continuous feedback resulting in a quickly dampened amplitude of irregular distribution.

The invention also proposes a set of means for carrying out the regulation of distribution by the method indicated above.

BRIEF DESCRIPTION OF THE DRAWINGS

The invention is described in detail below with reference to the annexed sheets of drawings, in which

FIGS. 5*a*, 5*b*, 5*c* and 5*d* illustrate schematically four types of configuration of distribution of the fibers across the felt.

FIG. 6 shows a form of combination of measures for demonstrating the fundamental characteristics of the distribution measured.

DETAILED DESCRIPTION OF THE INVENTION

Figure 1:
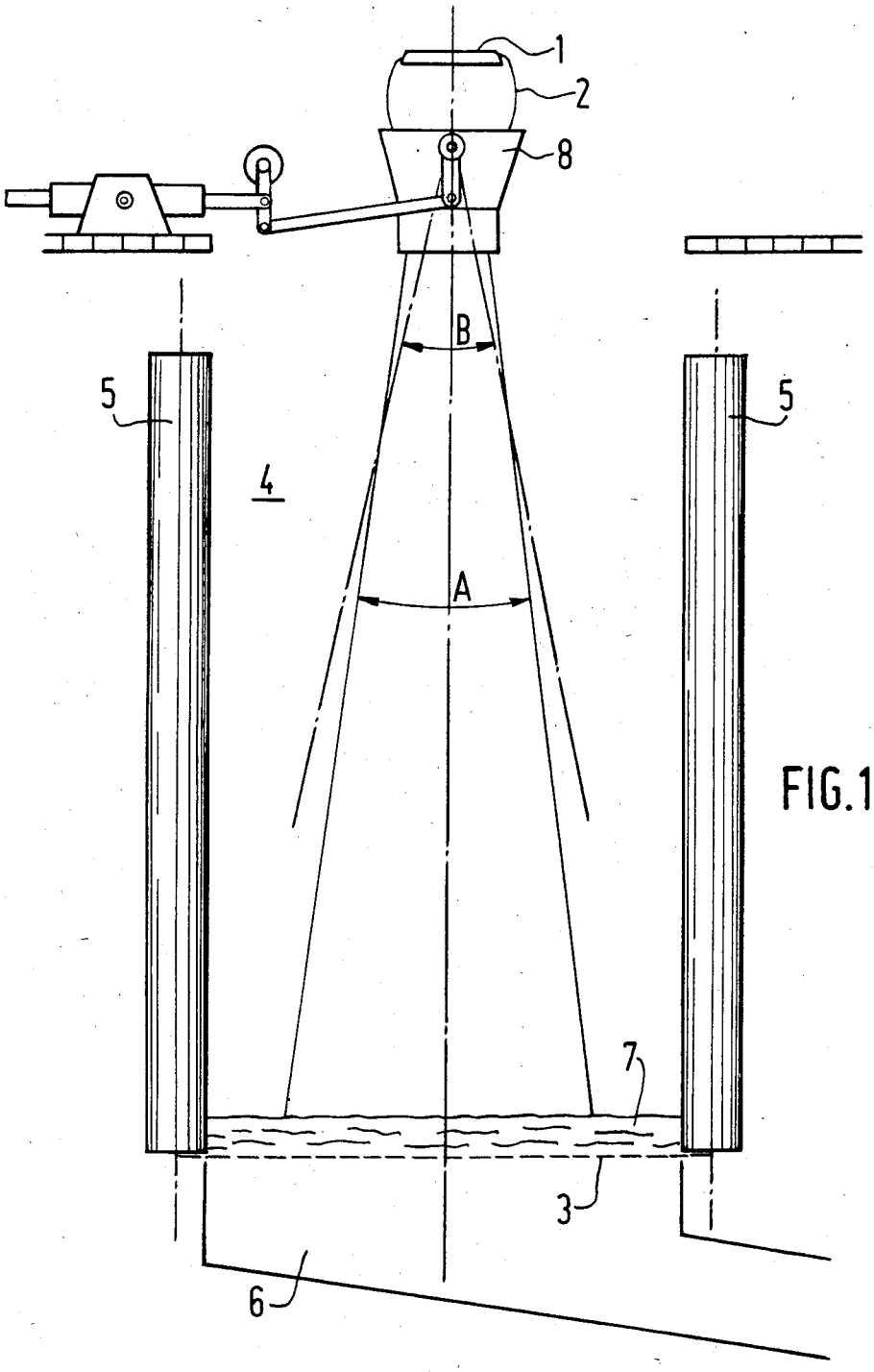
FIG. 1 is a schematic view of an installation for the formation of fiber felts viewed transversely to the direction of transport of the receiving conveyor.

The installation for the formation of felts shown in FIG. 1 comprises an apparatus for the formation of fibers, a receiving arrangement and distributing means.

In this figure, the apparatus for formation of the fibers is of the type in which the material to be fiberized is projected in the form of fine filaments from a centrifuge having a multiplicity of orifices. The filaments are then carried and attenuated by a gaseous current directed vertically downwards. The gaseous current is normally at a high temperature enabling the filaments to be maintained under suitable conditions for attenuation.

The fibers carried by the gaseous current form a sort of film 2 around and above the centrifuge 1.

This method of formation of fibers has been the subject of numerous publications. A detailed description of the operating conditions and apparatus may be found, in particular, in French Pat. No. 78 34616.

It is to be understood that this invention is not limited to a particular mode of formation of fibers but covers all techniques in which a felt of fibers is formed from fibers carried by a gaseous current. The example of formation of fibers by this technique of centrifugation has been selected because of its wide importance in the industrial field.

In this type of formation, the film of fibers contracts under the centrifuge for reasons pertaining to the geometry of the fiberizing device. The gaseous current carrying the fibers subsequently expands when it comes into contact with the surrounding atmosphere.

It should be noted that this expansion of the gaseous current is an entirely general phenomenon independent of the original form of the current and hence of the method of formation of fibers employed.

The gaseous current carrying the fibers is directed into a container 4 the base of which is formed by a perforated conveyor 3. This container is enclosed laterally so that the gaseous current cannot be evacuated except by passing through the perforated conveyor 3.

Walls 5 channel the flow of gas laterally. These walls may be movable, as indicated in FIG. 1. Such walls have the advantage that they may be continuously freed from any fibers which may adhere to them, especially if the fibers have been sprayed with a binder composition in their path towards the conveyor. The straying assembly is not shown in the drawing.

Observation of the gaseous current carrying the fibers shows that the expansion of the current takes place relatively slowly. In the case under consideration, the current adopts a conical form with an apical angle A of the order of 20°. The felts produced frequently have a width of more than 2 meters and since the current is originally fairly narrow, it is obviously not possible to obtain a sufficiently wide flow to cover the whole surface of the conveyor. This is shown in FIG. 1.

Underneath the conveyor 3, gas enters the box 6, which is maintained at a lower pressure than the container 4 by suction means (not shown).

The box 6 is arranged so that this suction takes place across the whole width of the conveyor 3, thereby avoiding the formation of undesirable turbulences in the container 4. This uniform suction to a certain extent also favors uniform ditribution of the fibers, the zones of the conveyor already charged with fibers having a greater resistance to the passage of gas, thereby opposing the accumulation of additional fibers.

The equilibrium which tends to become established on the conveyor by the presence of the fibers is, however, insufficient in itself to achieve suitable distribution on a conveyor which is very much wider than the gaseous current. The accumulation of fibers is greater at the center of the conveyor, that is to say, in the direct path of the gaseous current than at the sides.

An oscillating guide duct 8 is arranged in the path of the gaseous current for the purpose of improving the distribution of fibers. The current is channeled by the duct 8 which is so designed that its oscillations deflect the current, causing it to sweep over the width of the conveyor 3.

The guide duct 8 is placed in the upper part of the container 4, as far away as possible from the conveyor so that the changes in direction to be imparted to be gaseous current will be as small as possible. The gaseous current is also preferably channeled when its geometry is clearly defined, that is to say, as close as possible to the fiber forming device.

Figure 2:
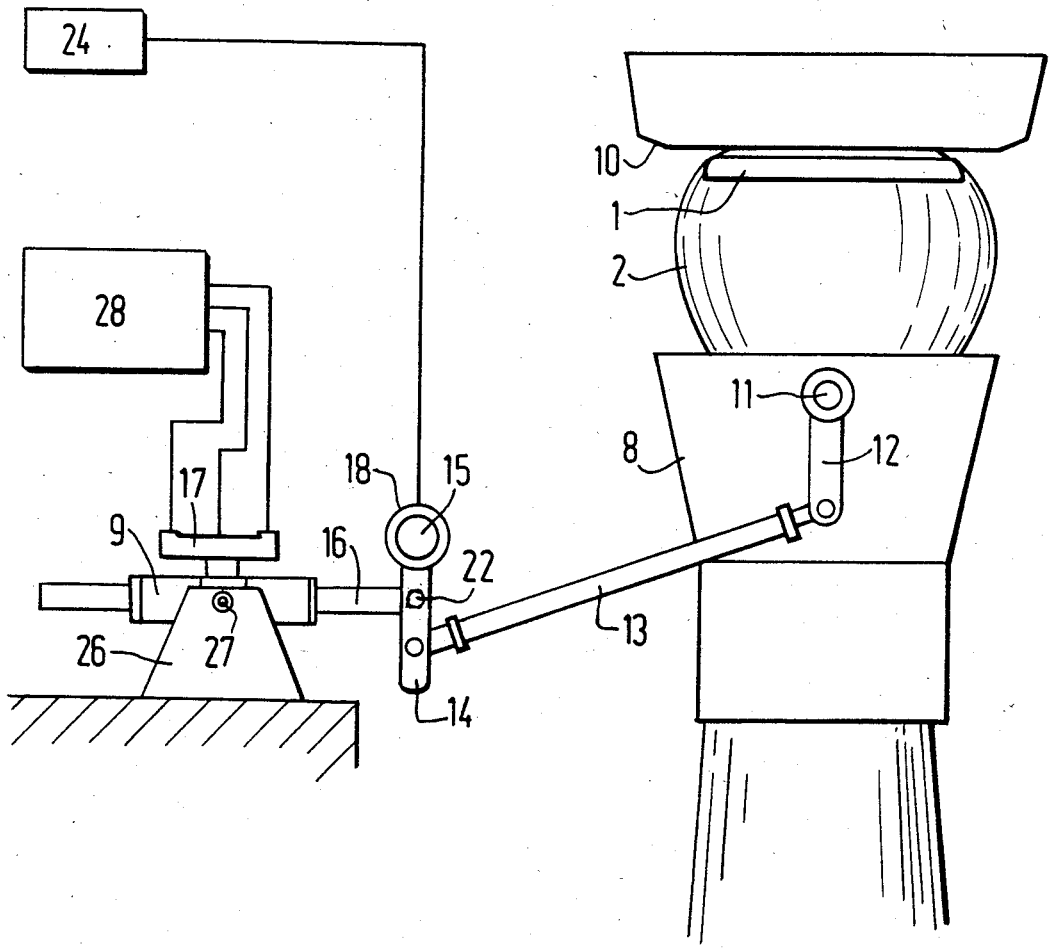
FIG. 2 is a partial view of FIG. 1 on an enlarged scale, showing more precisely the construction of the apparatus for distribution of the fibers.

FIG. 2 shows in more detail the guide duct 8 and the mechanism animating it in an arrangement according to the invention.

In prior techniques, and in particular in U.S. Pat. No. 3,134,145, the movement of the guide duct for the gaseous flow is obtained from a motor and a mechanical transmission comprising a cam and a set of links.

Improvements have been developed comprising a mechanism formed by a set of gears, the whole arrangement having the effect of producing a more complex movement of the duct. This movement comprises, for example, a higher speed of displacement in the end positions than in the mid-position.

The device for distribution of the fibers must be regulated with great precision. It will be seen in the examples of practical application of the invention that a very slight change in the parameters defining the movement of the guide duct causes a very significant change in the distribution. In the known apparatus, these adjustments are carried out by the operators before production is started. Interventions when production has already started are not entirely impossible but are difficult and temporarily interfere with the production process. In practice, these interventions are carried out only when very serious faults in distribution occur.

The apparatus used according to this invention, on the other hand, enables modifications in the operating conditions to be carried out without interrupting or even disturbing the production process. These modifications may therefore be carried out as often as desired. Even relatively small faults in distribution may be corrected so that products with substantially improved quality may be obtained.

In FIG. 2, the upper part of the guide duct has the form of a truncated cone slightly widening out in the direction of the fiber forming apparatus. This increase in width facilitates the channeling of the attenuating gas emitted from an annular attenuating device 10 at the periphery of the centrifuge 1.

The duct 8 is supported on two pivots 11 engaging on bearings fixed to mountings (not shown). The axis of rotation is placed sufficiently high on the duct so that the position of the opening of the duct in relation to the gaseous current is only slightly modified by the oscillation.

The oscillating movement is produced by a motor assembly which in the example illustrated consists of a hydraulic jack 9. This driving arrangement is obviously not the only one which may be used. An electric or electromechanical assembly, for example, could be provided to ensure both the oscillating movement of the duct 8 and the modification in the parameters determining this movement.

The movement is communicated to the duct 8 by a hinged mechanical transmission comprising the rod 16 of the jack 9, an arm 14, a link 13 and another arm 12 firmly connected to the duct 8.

The arm 14 pivots on an axle 15 mounted on bearings arranged on a fixed framework (not shown). The rod 16 of the jack 9 is connected to the arm 14 by a joint 22.

The jack 9 is supported on a framework 26 by pivots 27 allowing it a certain clearance in rotation in a vertical plane.

The link 13 hinged to the arms 12 and 14 in the form represented constitutes a deformable parallelogram with these arms. The two arms therefore move identically. Other, similar forms of assembly would obviously be possible within the scope of this invention. This particular arrangement has the advantage of simplifying the determination of the position of the duct 8, this determination playing some part, as will be seen herinafter, in the regulating process according to the invention.

The arrangement for the transmission of movement comprises a series of regulating means enabling the geometry of movement to be determined with precision. The conventional means for this type of assemby have not been illustrated.

The jack 9 has a double action. It may therefore be subjected to a reciprocating movement. Such a movement may also be obtained with two single action opposing jacks but a double action jack is preferable for convenience of operation.

The operation of the jack 9 is controlled by a proportional distributor indicated at 17 which regulates the rate supply of fluid into the jack and is associated with a hydraulic center supplying fluid under pressure, indicated by the block 28.

The excursion of the jack 9 and the construction of the mechanical transmission are chosen so that the oscillation of the guide duct 8 may respond to any requirements encountered in practice. In other words, the limits of the movement, indicated, for example, in FIG. 1 by the angle B formed by the axis of the conduit in its two end positions, are such that the gaseous current would extend beyond the whole width of the conveyor if it did not strike the lateral walls 5.

The use of a hydraulic jack offers great facility for controlling movement. The amplitude may, of course, be modified or the end positions may be modified while maintaining the same amplitude. The speed may also be varied.

The movement which may be imparted to the jack 9 and therefore communicated to the guide duct 8 may follow any desired plan. For example, the jack may be subjected to an operating program in which the speed varies in the course of one oscillation according to a complex law, and variations in several of the parameters determining the movement, such as speed, frequency, amplitude and end positions, may be combined.

All these modifications are carried out without interruption of the movement, by suitable control of the proportional distributor.

The hydraulic jack constitutes a preferred means according to the invention due to its sturdiness and flexibility of use, although other means may equally well be used to produce this type of variable movement as indicated above.

The distribution device used according to this invention is thus well-adapted to frequent corrections in the mode of distribution such as may appear necessary in the course of production of the felts.

No matter what precautions are taken, the dispersion of fibers on the conveyor is subject to numerous chance factors. It would obviously be very difficult to maintain a perfectly stable gaseous flow inside the container 4. Considerable induced currents develop in addition to the current carrying the fibers. Furthermore, a single container normally contains a plurality of fiber forming devices each with its own gaseous current which influence each other. Consequently, and in spite of the suction under the conveyor, the container 4 is the site of vigorous turbulences. In addition to these factors causing irregularity in the gas flow, there may in some cases be an accidental lack of uniformity in the suction.

Whatever the causes, experience has shown that irregularities in the transverse distribution of the fibers appear in the course of operation and persist for relatively long periods so that it becomes desirable to modify the operating conditions of the guide duct with a view to re-establishing greater uniformity.

Another advantage of the use according to this invention of hydraulic means for actuating the guide duct is that it enables automatic control to be employed. As the variations mentioned above occur irregularly and are not predictable, it is very desirable that corrections should be made as soon as a fault in distribution is detected.

Measurement of the distribution of the fibers in the formed felt may be carried out by various methods. In the context of automatic regulation, the methods used should operate continuously and not disturb production.

One preferred method consists of measuring the absorption of radiation, in particular of X-rays, but other methods capable of determination of relative density and distribution could equally well be envisaged.

The method of measuring by absorption of X-ray is preferred when the felt is thick, in other words when there is considerable absorption. For thinner and therefore less absorbent fiber layers, such as the products referred to as "films," a method of measurement using beta radiation for example, may be preferred.

The method of measuring the mass of fibers per unit surface area on the felt by X-ray absorption is carried out according to this invention in accordance with clearly specified particulars.

Thus the apparatus used for measurement should be situated at a point on the production chain suitable for providing a significant measurement.

On leaving the receiving container 4, the formed felt is frequently loaded with moisture, in particular from a solution of binder sprayed on the fibers. Water may also be sprayed on the path of the fibers to cool the attenuating gas and the fibers carried by it. Water, which strongly absorbs X-rays may therefore substantially modify the results of measurement if it is not uniformly distributed. It is therefore advantageous to carry out the measurement at a point along the production line where the felt is free from moisture.

The measurement of the mass of fibers per unit surface area is therefore preferably carried out at the exit from the container in which the binder treatment is carried out.

If, however, the accumulated fibers carry only little moisture or if this moisture is well-distributed, the measurement may be carried out before treatment, as soon as the fibers leave the receiving container.

When measurement is carried out after treatment with the binder, it would take place at a relatively great distance from the location where distribution of the fibers takes place. Between the deposition of the fibers on the conveyor belt and their passage to the point of measurement, several minutes may elapse, even as much as 10 minutes. This delay, which is thus introduced systematically in the operation of regulating the distribution according to the measured faults in uniformity, is, however, no great disadvantage. As is shown in the examples below, the means of regulation according to the invention may be used to correct faults in distribution which manifest themselves over relatively long periods compared with the delay in question. Furthermore, in the course of production, the irregularities are normally progressive. If they are correctd as soon as they appear, the deviations normally remain relatively minor and do not interfere with production.

The measurements should be carried out over the whole width of the felt, and the measuring apparatus is therefore designed to be displaceable transversely to the felt.

Figure 3:
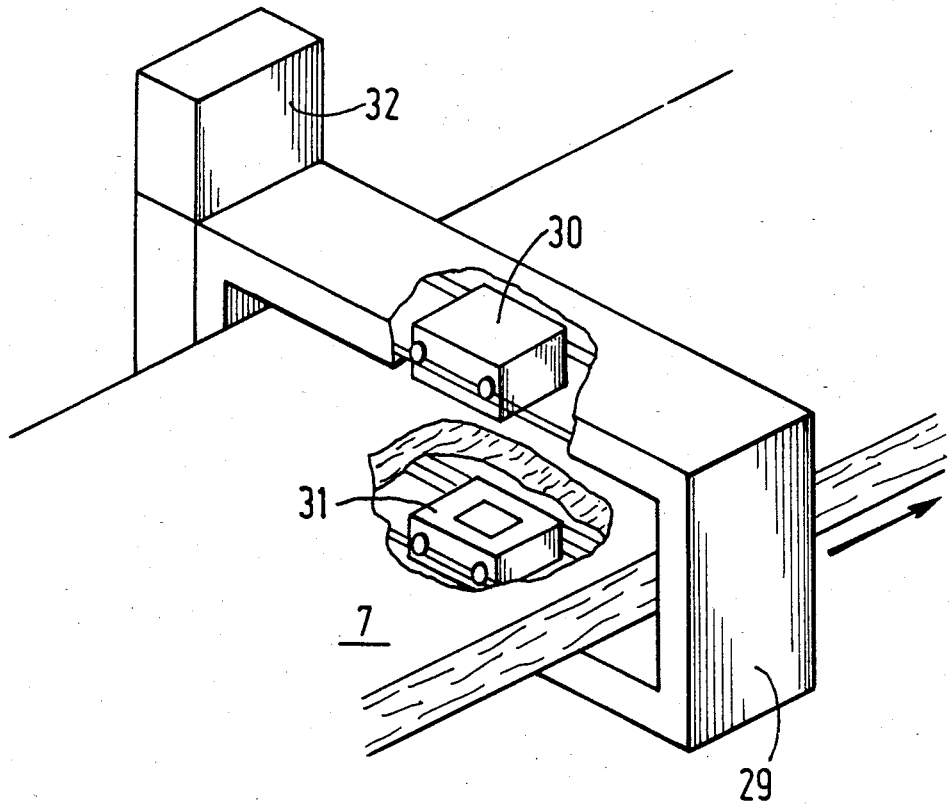
FIG. 3 is a schematic view showing an arrangement for measuring the mass of fibers per unit surface area.

FIG. 3 is a schematic representation of a measuring apparatus used according to the invention.

In this figure, the felt 7 passes through a frame 29 the upper, transverse part of which supports a source 30 of radiation emitted in the direction of the felt 7.

The emitting source 30 is movably mounted on rollers. It is displaceable transversely by a system of chains (not shown) in the frame.

A displaceable receiver 31 in the lower transverse part is situated opposite the emitting source. The receiver is moved identically to the source, also be a system of chains.

A single driving assembly in the box 32 ensures perfectly synchronized movement of the source 30 and receiver 31.

The radiation emitted is partially absorbed by the felt, and the fraction of radiation reaching the receiver is measured.

The measurements are carried out during displacement of the apparatus and each measurement corresponds to a fraction of the width of the felt over which the apparatus sweeps.

The duration of each measurement, and consequently the width of the fraction analyzed, may be chosen according to the use which is to be made of these measurements.

The measurements should be carried out over such fractions of the width of the felt that the discontinuous structure of the fibrous material does not prevent significant values being obtained. The minimum width of the "sample" over which the measurement is carried out is a function of the mass per unit surface area of the felt. The denser the felt, the smaller is the minimum width of sample.

For felts having a mass per unit surface on the order of 1 to 3 kg/m$^2$, a width of measurement of a few millimeters to a few centimeters, up to about 10 centimeters, is sufficient.

In practice, as will be seen later, regulation of the apparatus distributing the fibers can only be carried out on a limited number of parameters. A large number of measurements is therefore only purposeful to the extent that it provides additional possibilities in the treatment of these measurements.

Figure 4:
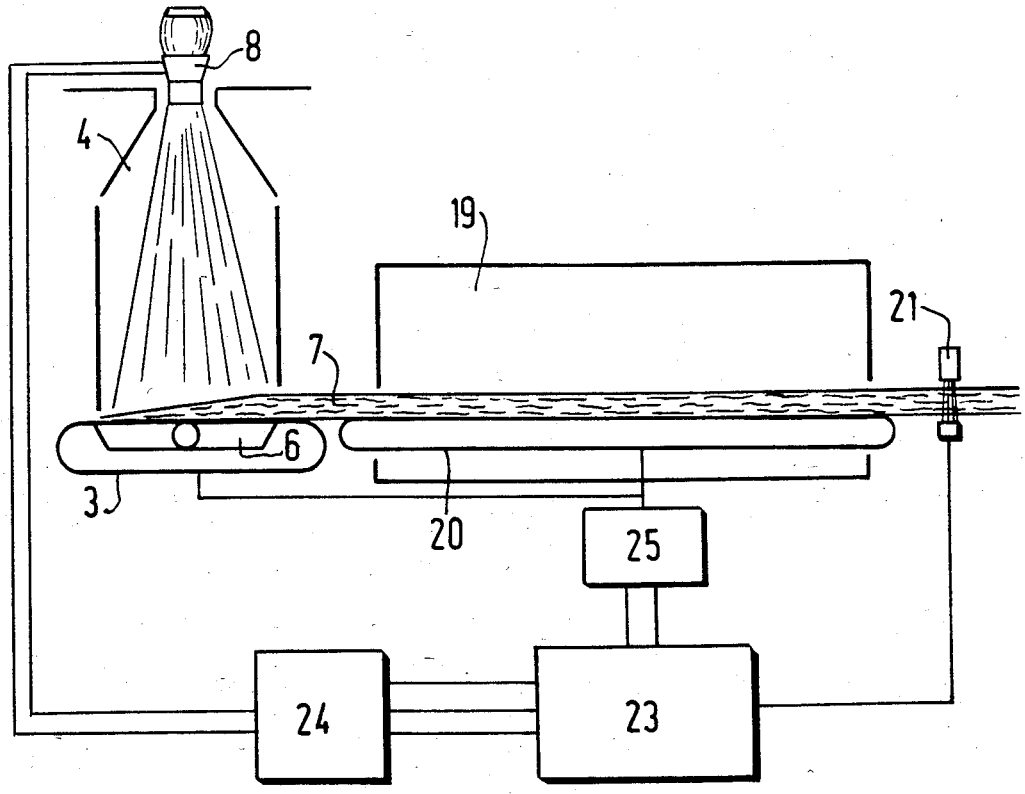
FIG. 4 is an overall schematic view illustrating how the system of distribution of fibers of the invention is regulated.

FIG. 4 shows schematically the arrangement for regulating the felt forming installation insofar as it relates to the distribution of fibers.

The figure shows a single device for the formation of fibers. This type of installation normally has 6 to 12 such devices aligned along the conveyor 3 in the container 4.

In the case of installations comprising several fiber forming devices, each such device is advantageously equipped with a distributing system of the type used according to the invention. The movement of these devices may be identical or not, as the case may be. The devices are generally, but not necessarily, subjected to a movement of the same frequency and the movements need not necessarily by synchronized.

The amplitude and mean direction may also be adjusted to vary from one device to another.

When automatic regulation is carried out according to this invention, it may act on one or more than one device of the same installation.

The felt 7 leaving the container 4 is taken up by the conveyor 20 moving at the same speed as the conveyor 3. The felt passes through a stove 19 where it is subjected to a circulation of hot air to polymerize the binder.

At the exit from the stove 19, the dry felt enters the X-ray absorption measuring device 21.

The regulating circuit employed is as follows:

The measuring device 21 transmits the magnitudes corresponding to the absorption of the analyzed "sample" and the position of this sample on the felt to a computer indicated at 23.

The computer 23 also receives information on the operation of the distributing device by means of the regulating assembly represented by the block 24. In particular, the computer receives signals relating to the position of the guide duct 8. This position may be registered, for example, by a potentiometric detector 18 (FIG. 2) which follows the movement of rotation of the arm 14 about the axle 15.

The computer 23 may also receive information relating to the speed of displacement of the felt 7 by means of a control system 25 regulating the speed of the conveyors.

The computer compares these informations with a set of data in its memory in terms of the deviations found and produces instructions which are transmitted to the regulating assemblies 24 and 25. These assemblies then modify, respectively, the operation of the distributing apparatus and the speed of the conveyors.

As already indicated above, the parameters available for controlling the distribution of fibers are few in number.

The speed of advance of the conveyors is able to modify the mass per unit surface area of fibers in a general manner but not the transverse distribution. The overall quantity of fibers is normally determined at the moment when these fibers are formed, for example by regulating the quantity of material to be fiberized, assuming that the speed of the conveyor remains constant.

The presence of an assembly for measuring the mass per unit surface area of felt, however, provides the means for automatic control of the speed as indicated above. For this purpose, the computer 23 is instructed to integrate the local measurements in order to determine the mass per unit surface area over the whole felt. A comparison of the results obtained with an imposed value commands the acceleration or deceleration of the conveyors according to whether this mass is found to be greater or less than the imposed value.

The parameters which determine the operation of the distributing duct 8, and hence the transverse distribution of the fibers, are the frequency of oscillation, the amplitude of oscillation and the mean direction.

The frequency is an important factor for obtaining good distribution of the fibers on the conveyor. When felts with a large mass of fibers per unit surface area are to be formed, several successive depositions of fibers are normally superimposed on each other, each obtained from one of a series of devices in alignment as described above. In that case, the frequency has less influence above a certain relatively low minimum threshold. For lighter weight felts, precise regulation of the frequency is much more important for the final result.

The frequency should generally be sufficient to ensure that the whole surface of the moving conveyor is effectively covered by the flow carrying the fibers. When several fiber forming devices are put into operation for producing one felt, however, it is not absolutely necessary for each flow to completely cover the surface. It is sufficient in that case if all the devices together effectively produce a complete covering.

It is, however, not advantageous to increase the frequency excessively. The improvement which could thereby be obtained is not substantial and is in any case limited by the inertia of the film of fibers. It is found that beyond a certain frequency, the movement of the gaseous current can no longer folow the movement imposed on the guide duct. Effective regulation of the distribution of the fibers then becomes impossible.

The frequency may be regulated, for example, as a function of a previously determined optimum for each mass per unit surface area value. The frequency regulation may then be combined with the regulation of the speed of movement of the conveyor as a function of the mean mass per unit surface measured over the whole width of the felt.

The amplitude and median direction of movement of the guide duct directly determine the transverse distribution of the fibers. The use of guide ducts in conventional methods has enabled single results to be isolated to show how the different parameters affect the distribution. The modification in median direction while the amplitude remains constant gives rise to a displacement in the deposition of fibers in the same direction as this modification. Bearing in mind the presence of the lateral walls, this displacement in fact results in an increase in the mass of fibers per unit surface area on the side to which this displacement is directed. Similarly, it is found that an increase in the amplitude of movement favors the deposition of fibers along the edges of the conveyor at the expense of the center, and conversely.

The measurements carried out on the mass of fibers per unit surface area and their treatment by the computer have in particular the object of obtaining the best possible control of these two parameters. Models of distribution have therefore been drawn up, to which the answers correspond, the whole arrangement beig stored in the memory of the computer.

Four basic forms of distribution have been distinguished. These four distributions are represented schematically in FIGS. 5*a*, 5*b*, 5*c* and 5*d*. These figures show the deviation in mass per unit surface area from the mean value over a transverse section of the felt. For the mean value, the deviation is zero. These four forms correspond, respectively, to the gaseous current shifted to the left (FIG. 5*a*), shifted to the right (FIG. 5*b*), at too high an amplitude of oscillation (FIG. 5*c*) and too low an amplitude (FIG. 5*d*).

The correction to be imposed upon the operation of the guide duct is determined by comparing the measurements, processed and evaluated as described, with these four models.

Processing of the measurement comprises, firstly, the collection of several measurements corresponding to successive passages at the same position in the width of the felt. The mean value deduced therefrom is then a more complete and precise image of the effective distribution in the zone under consideration. The measurements are also regrouped by sectors, which are then evaluated. The choice of sectors and their respective evaluation is determined by tests so that the values obtained will be representative of the distribution and the corrections carried out will result in an effective improvement.

The processing of these values is also chosen as far as possible to reflect all the configurations or dimensions of the installations equipped with these regulating systems.

A preferred method of regrouping measurements of the mass of fibers per unit surface area is indicated in FIG. 6. In this method, for example, the width of the felt L is divided into four sectors which partially overlap. The regrouped, evaluated measurements in these four sectors ensure that excessive importance is not given to measurements corresponding to the sides of the felt compared with the center part.

Other methods of processing, could, of course, be employed. Tests in each case show the significance of the method studied for resolving the problems encountered in practice.

EXAMPLES

By way of example, tests have been carried out on a pilot installation for the formation of felt from glass wool. This installation contained only one fiber forming device. These examples are not intended to limit the invention.

I.

The fiber forming device and the arrangement of guide duct and driving system are of the type represented in FIG. 2.

In this installation, the felt has a width of 2.40 m. It has a mass per unit surface area of 1 kg/m$^2$.

Since only a single fiber forming device is used, the speed of the receiving conveyor is relatively low, being 5.25 m/min.

The felt leaving the receiving chamber passes through a stove.

At the exit from the stove, the felt passes through an X-ray absorption measuring device using americium 241 as its source. This movable source passes over the whole width of the felt in 32 seconds. Sixty-four measurements are taken in the course of each movement over the width of the felt. The values are registered together with their position.

A sliding mean is established over the last 8 passages of the X-ray probe.

The values are grouped into four bands I, II, III, IV as indicated in FIG. 6.

The regulation is carried out on the basis of the mean values obtained for these four bands according to the method described above.

Beween two successive corrections, it is necessary to take into account the delay between the formation of the felt and the measurement. In this case, this delay is 10 minutes. It is also necessary to take into account the time corresponding to at least eight successive passages of the X-ray probe over the formed felt subsequent to the preceding correction in order to obtain the eight fixed measurements.

In these tests, the corrections are carried out systematically at intervals of 18 minutes.

Figure 7:
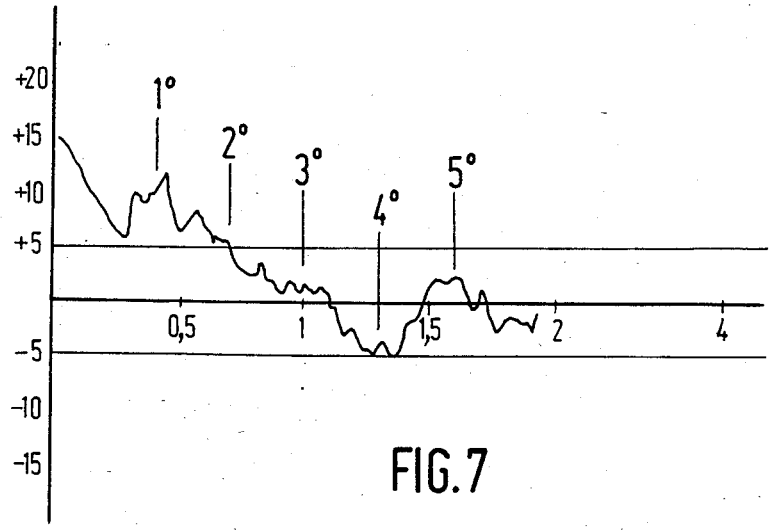
FIG. 7 represents an example of the evolution of distribution of fibers when the means for regulation according to the invention are carried out.

FIG. 7 shows the evolution in the distribution of fibers over a lateral strip of felt of a width of 30 cm. The corresponding value is then the mean of eight measurements for each of the eight measurements for each of the eight successive passages, amounting to a total of 64 measurements.

The graph shows the relative deviation in density of the strip under consideration compared with the mean mass per area over the whole width of the felt. The moment at which corrections are carried out is indicated by a vertical bar.

The initial movement of the guide duct corresponds to an amplitude defined by the half angle B of 8.7° and a median direction making an angle of +0.8° with the vertical. The frequency of oscillation, which remains unchanged during the tests, is 60 forward and return movements per minute.

Initially, that is to say, before the first corrections, the deviation from the mean varies from +15 to +7%. After two corrections, this deviation is rapidly reduced to less than 5%. It is thereafter constantly below 5% in relative value, and after the fifth correction, it falls to less than 3%.

The improvement thus obtained is remarkable.

It should also be noted that if the mass per unit area of the lateral strip chosen has been corrected, similar measurements carried out on other fractions of the felt show that over the felt as a whole, the deviations are maintained at a value below 5% of the mean value. In other words, corrections carried out which have succeeded in improving the distribution over the outer strip have not been to the detriment over the distribution of the remainder of the felt.

The correction introduced according to this invention is an extremely precise operation. At the end of the fifth correction applied, the amplitude of movement of the guide duct is 8.14° and the median direction makes an angle of −0.5° with the vertical. The modifications imposed on the movement are thus very small.

These modifications indicate the degree of sensitivity of the distribution to the parameters of movement of the distribution duct and what difficulty could be encountered in arriving at a regulation of equal quality if it were carried out manually, supposing that the device actuating the guide duct could be corrected in this manner.

II.

Figure 8:
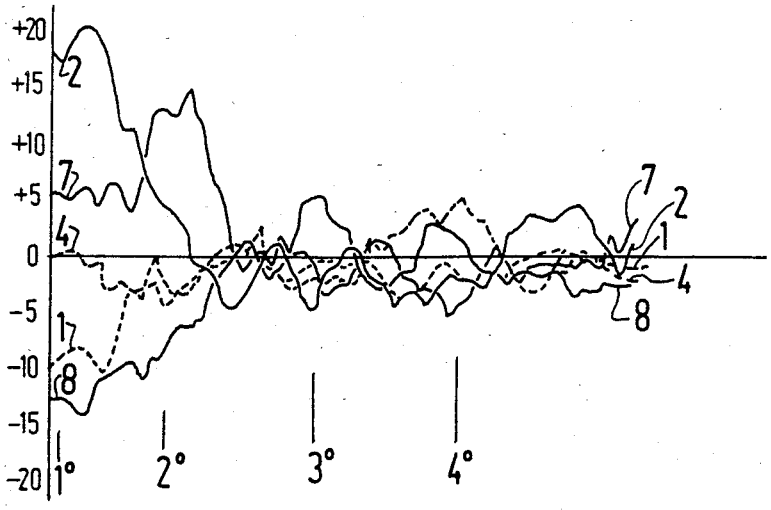
FIG. 8 represents another example, analogous to that of FIG. 7.

FIG. 8 also reproduces a regulating test carried out on the same device as previously described.

These measurements correspond to eight separate strips across the width of the felt. The measurements for the strips 1, 2, 4, 7 and 8 have been represented by way of indication.

This example is of interest since in this case the distribution was originally particulary irregular. Thus adjacent strips 1 and 2 or 7 and 8 have deviations of which one is positive and the other negative in relation to the mean.

In the present case, the mean mass per unit area is 1.3 $kg/m^2$.

The half angle B defining the amplitude of movement is initially 12.35° and the deflection from the vertical is initially −10.61°.

The corrections are indicted on the time scale by a vertical bar.

It should be noted that after two corrections, the deviations for all the values, including those that are initially the worst (+18% for strip 2, −12% for strip 8) have been brought within an interval of from +5% to −5%. The values subsequently remain within this interval.

At the fourth correction, the half angle B is 12.72% and the median direction is −10.25°. As in the example illustrate in FIG. 7, the variations leading to an improvement in the distribution of the fibers are extremely small.

The invention has been disclosed with respect to particular embodiments and examples. Particularly, specific fibers, mechanics and values have been identified which are not intended to limit the invention unless so indicated. Variations will occur to those of ordinary skill in the art without the exercise of inventive faculty, and remain within the scope of the invention as claimed below.

What is claimed as new and desired to be secured by Letters Patent of the United States is:

1. A process for improving the distribution of fibers in a felt formed by blowing a gaseous current carrying fibers onto a perforated conveyor which retains said fibers while allowing said gas to pass therethrough, said process comprising:

directing said current to sweep over the width of said conveyor in an oscillating movement, and automatically regulating during operation the frequency, amplitude and median direction of said sweep and the speed of said conveyor according to measurements taken of the mass of fibers per unit surface area of the width of said formed felt, said regulation being calculated to minimize deviations in the value of said mass across the width of said felt.

2. The process of claim 1, wherein the mass of fibers per unit surface area of the felt is measured by radiation absorption of the felt.

3. Apparatus for the formation of a fiber felt of improved distribution, comprising:

means for producing a gaseous current carrying fibers, a receiving container receiving said gaseous current, said container comprising as the floor thereof a gas permeable conveyor retaining said fibers, means for causing said gaseous current to sweep over the width of said conveyor in an oscillating motion, comprising a rotatable guide duct, the movement of which may be modified as to frequency, amplitude and median direction by modification means, and, means for regulating said modification further comprising means for measuring the mass of fibers per unit surface area of the formed belt, means for comparing the measurement so taken with predetermined values, and a means for producing signals to said modification means directing the alteration of said oscillating motion, said signals being provided such that said frequency, amplitude and median direction may be automatically regulated during operation of said apparatus.

4. The apparatus of claim 3, said means for producing a gaseous current comprising a centrifuge having a plurality of orifices from which are projected fiber filaments, and means for producing an annular gas current which gas current flows along the periphery of said centrifuge, and wherein said guide duct is of circular cross-section and is situated proximally to said centrifuge.

5. The apparatus of claim 3, wherein said modification means comprises a double action hydraulic jack connected to said guide duct, and a proportional distributor regulating liquid applied to said jack.

6. The apparatus of claim 3, wherein said means for measuring the mass of fibers per unit surface area comprises a means for measuring the absorption of radiation by the felt.

7. The apparatus of claim 6, wherein said measurement means comprises a source of x-rays directed through said felt and a means for determining the amount of x-rays absorbed by said felt, said measurement means being displaceable in the direction of the width of the felt.

8. The apparatus of claim 5, wherein said hydraulic jack comprises an excursion rod, and said measurement means produces a signal to a regulating circuit which controls the amplitude and mean position of the movement of said excursion rod.

9. The apparatus of claim 7, further comprising a regulating circuit which controls the speed of the conveyor and frequency of the oscillating movement of the guide duct in response to signals received from said measurement means.

10. The apparatus of claim 3, comprising a plurality of said means for producing a gasesous current carrying fibers.

* * * * *